US006072572A

United States Patent [19]

Hatfield et al.

[11] Patent Number: 6,072,572

[45] Date of Patent: Jun. 6, 2000

[54] COMMON APERTURE MULTI-SENSOR BORESIGHT MECHANISM

[75] Inventors: Dean Hatfield, Los Angeles; Paul Kiunke, Long Beach, both of Calif.

[73] Assignee: Raytheon Company, Lexington, Mass.

[21] Appl. No.: 08/262,400

[22] Filed: Jun. 20, 1994

Related U.S. Application Data

[63] Continuation of application No. 07/989,408, Dec. 11, 1992, abandoned.

[51] Int. Cl.[7] ..... G01B 11/26; G01J 5/02

[52] U.S. Cl. ..... 356/152.3; 250/342

[58] Field of Search ..... 250/342; 244/3.16; 356/152.3

[56] References Cited

U.S. PATENT DOCUMENTS

| | | | |
|---|---|---|---|
| 3,644,043 | 2/1972 | Jones et al. | 356/5 |
| 3,854,821 | 12/1974 | Thompson | 356/152 |
| 4,025,194 | 5/1977 | Teppo . | |
| 4,422,758 | 12/1983 | Godfrey et al. | 356/152 |
| 4,774,473 | 9/1988 | Johnson et al. | 372/33 |
| 4,811,061 | 3/1989 | Sud et al. | 356/152 |
| 4,902,128 | 2/1990 | Siebecker et al. | 356/152 |
| 5,025,149 | 6/1991 | Hatfield, Jr. | 250/342 |
| 5,054,917 | 10/1991 | Pepin et al. | 356/152 |
| 5,089,828 | 2/1992 | Moss . | |
| 5,200,622 | 4/1993 | Rouchon et al. | 250/334 |

*Primary Examiner*—Stephen C. Buczinski
*Attorney, Agent, or Firm*—Colin M. Raufer; Leonard A. Alkov; Glenn H. Lenzen, Jr.

[57] ABSTRACT

A boresight mechanism 10 incorporating internal boresight target generator 28 to generate a boresight target signal for properly aligning first and second sensors 22, 24. Beam splitter 52 and corner reflector 60 are positioned along optical path 100 such that sensor 22 and sensor 24 can view either the boresight target signal or a target signal without requiring optical elements to be slued into and out of position to provide a clear line of sight.

11 Claims, 3 Drawing Sheets

COMMON APERTURE MULTI-SENSOR BORESIGHT MECHANISM

This is a continuation application Ser. No. 07/989,408 filed Dec. 11, 1992 now abandoned.

BACKGROUND OF THE INVENTION

1. Technical Field

The present invention relates generally to a multiple sensor, electro-optical fire control system employing a common aperture and, more particularly, to a boresight mechanism having an internal boresight target generator for properly aligning the infrared and visible sensors of the electro-optical fire control system without firing the laser, and which does not require the line of sight to be moved to view externally mounted reflectors or sources.

2. Discussion

Current military weaponry employ electro-optical fire control systems to detect, track and deliver weapons to desired targets. These fire control systems often use multiple sensors, such as visible sensors (TV) and forward looking infrared sensors (FLIR), and lasers to perform these functions. These sensors require extremely accurate boresighting in order to satisfy the error limits imposed by the associated weapons, especially precision laser guided weapons.

Current fire control system technology employs an external boresight target for aligning and calibrating the TV and FLIR sensors located off-gimbal at which the laser is fired in order to generate a boresight target signal. This shortens the operational life of the laser, increases the time required to appropriately boresight the sensors and creates a potential hazard for the personnel operating the system.

Furthermore, most current fire control systems employ multiple apertures to allow each sensor to view targets simultaneously. The use of numerous apertures is not desired since the apertures are vulnerable targets for enemy fire and are difficult to protect or camouflage. A further limitation of current fire control systems is that the optical components of the fire control system must be slued into and out of position to boresight the system.

As such, many configurations used today for multiple sensor electro-optical fire control systems lack the ability to be quickly and accurately boresighted while maintaining a common aperture for all of the components of the fire control system. Accordingly, it is an object of the present invention to solve one or more of the aforementioned problems.

SUMMARY OF INVENTION

In accordance with the objectives and advantages of the present invention, a common aperture multi-sensor, boresight mechanism is provided that incorporates an internal boresight target generator to generate a boresight target signal for properly aligning the electro-optical fire control system. A beam splitter and corner cube reflector are positioned along the fire control system's optical path for allowing a visible sensor and an infrared sensor to view the internally generated boresight target signal while maintaining the sensors' capabilities to view a target signal received through a telescope. Additional beam splitters are used to collimate the boresight target signal and to separate the target signals viewed by the sensors into its visible and infrared frequency components.

The preferred embodiment of the present invention also incorporates a laser for generating a rangefinder/designation signal to locate and designate desired targets along the same optical path as the boresight target signal. Higher boresight accuracy is achieved by generating and sensing both the boresight target signal and the laser designation signal in pre-expanded (i.e., low magnification) space. In addition, shutter means are employed along the optical paths to block undesired radiation from destroying the sensors or being transmitted out through the telescope.

BRIEF DESCRIPTION OF THE DRAWINGS

The various features and advantages of the present invention may be more readily understood with reference to the following detailed description taken in conjunction with the accompanying drawings, wherein.

DESCRIPTION OF THE PREFERRED EMBODIMENT

Figure 1:
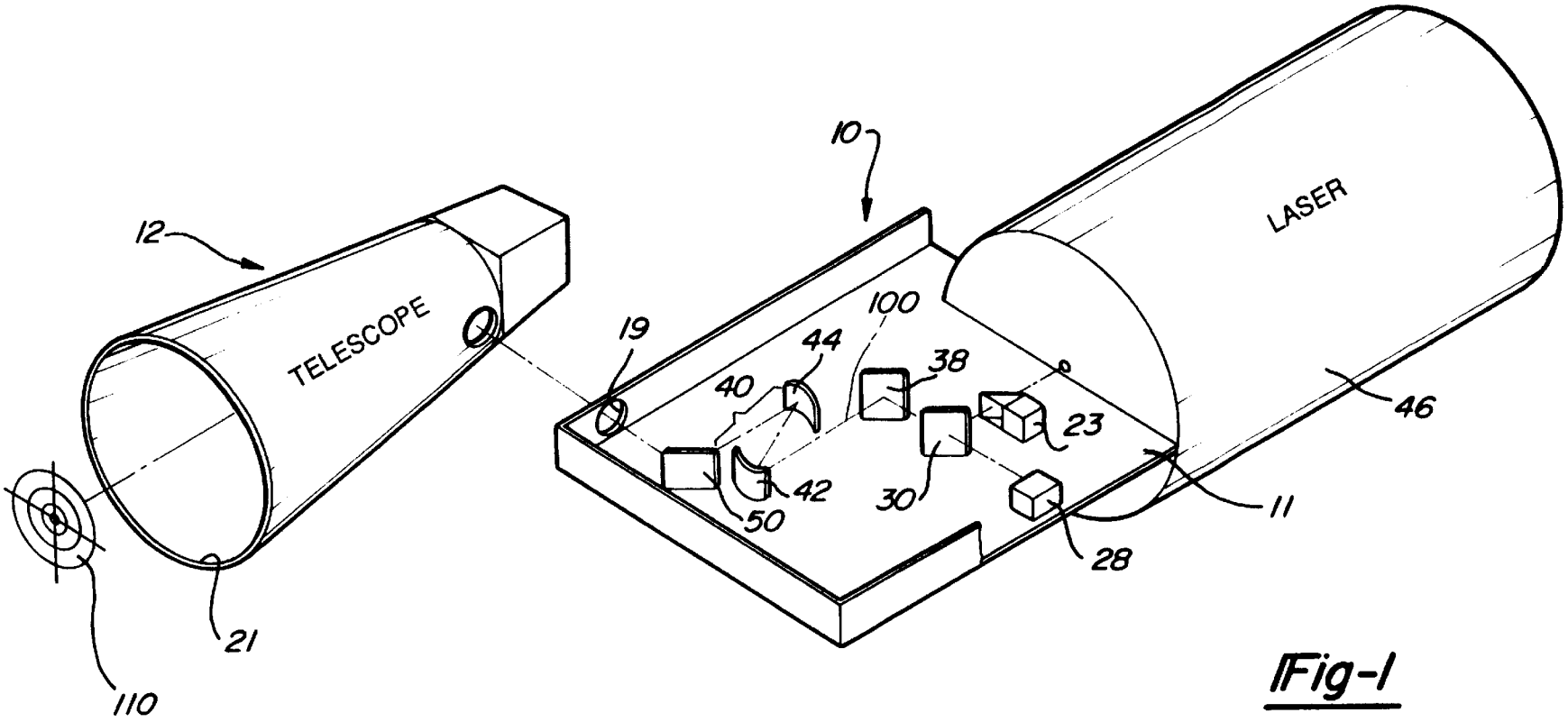
FIG. 1 is a perspective of the common aperture multisensor boresight mechanism showing the relationship of the various components in accordance with the principles of the present invention.

Referring now to FIG. 1, boresight target generator 28 and laser 46 are attached to optical bench 11 such that a signal generated by either is transmitted along a common optical path. Various optical elements, including 36, 38, 42, 44 and 50, further detailed herein, are employed to allow a target signal, either generated by boresight target generator 28 or received through telescope 12, to be viewed by first and second sensors 22, 24 (not shown).

Boresight mechanism 10 can operate in either a boresight mode or a designating mode. In boresight mode a boresight target signal is internally generated by boresight target generator 28 and projected through the optical elements of boresight mechanism 10 to precisely align first and second sensors 22, 24 (not shown). In rangefinder/laser designation mode laser 46 produces a designation signal by generating light pulses which are projected through telescope 12 thereby designating target 110 and causing a return signal to be reflected therefrom. During rangefinder/laser designation mode sensors 22, 24 can be employed to view the return signal received through telescope 12. The return signal can be transmitted to rangefinder 23 along optical path 100 to determine the range of target 110. The return signal can also be tracked by a laser homing weapon to guide and deliver the weapon to the desired target. While the present invention, as described, employs laser 46 for generating the designation signal, one skilled in the art would readily recognize that the boresight mechanism of the present invention may be employed in a common aperture multisensor fire control system that utilize other types of target designation signals.

Figure 2:
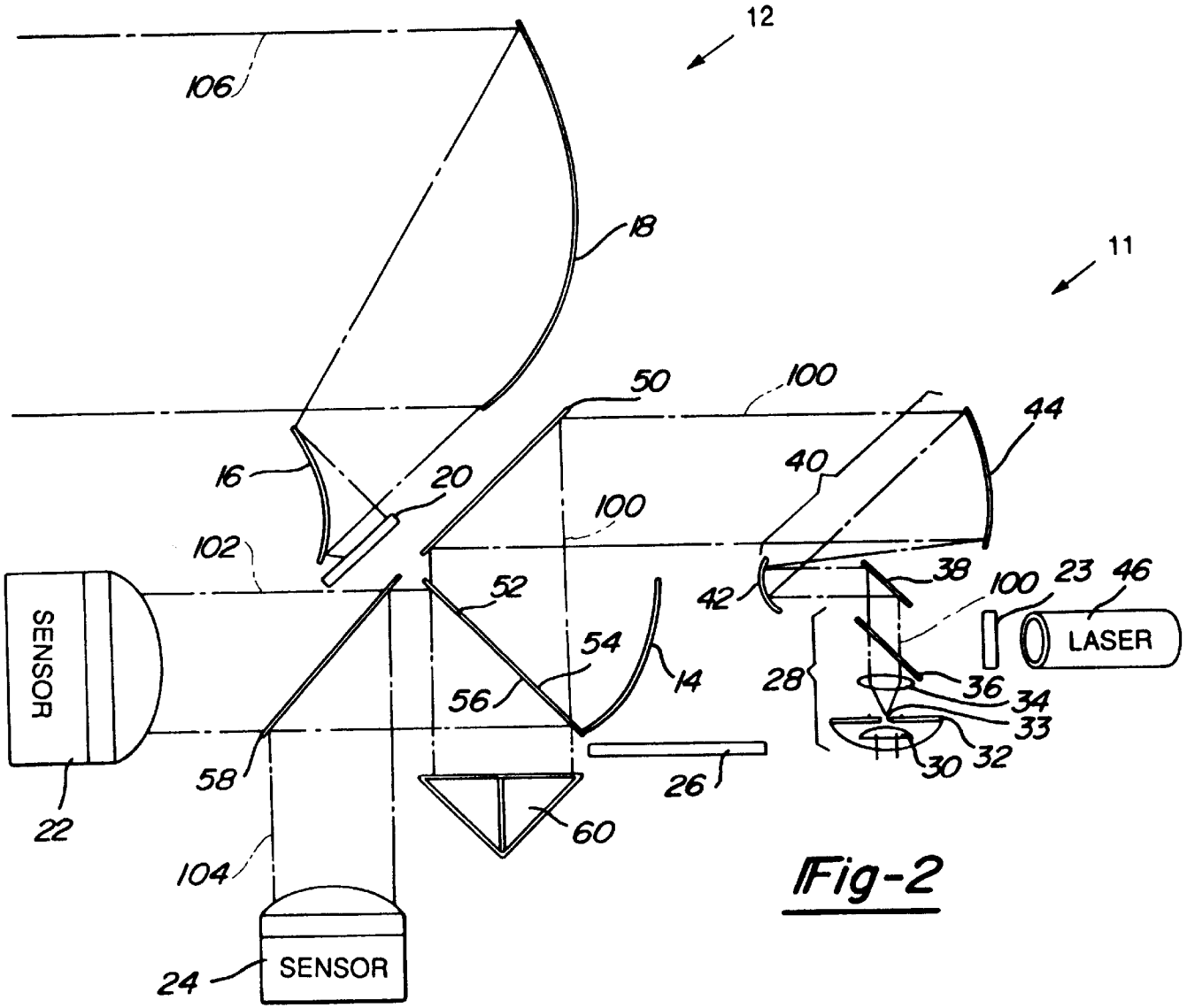
FIG. 2 is a schematic drawing of the boresight mechanism showing the optical components of the present invention in their organizational relationship operating in a boresighting mode.
Figure 3:
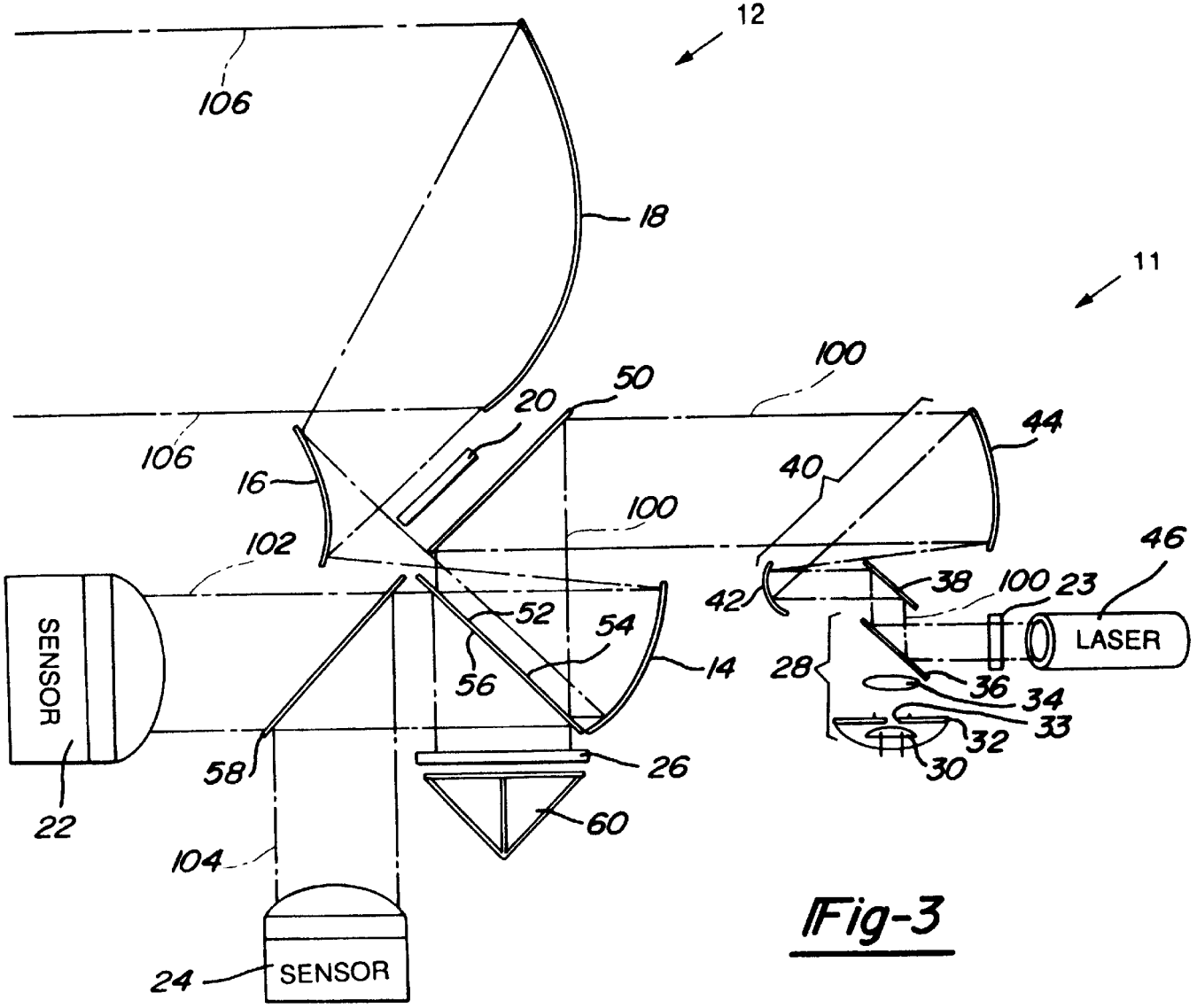
FIG. 3 is a schematic drawing similar to FIG. 2 showing the present invention operating in a laser rangefinding/designation mode.

Referring now to FIGS. 2 and 3, boresight target generator 28 includes source bulb 30 located behind target plate 32 having pinhole aperture 33 located therein for attenuating a broadband, incandescent, boresight target signal produced by source bulb 30. The boresight target signal is projected along optical path 100. Collimating lens 34 and beam splitter 36 located along optical path 100 as shown are adapted to collimate the visible and infrared frequencies generated by boresight target generator 28.

Laser 46 is located adjacent to beam splitter 36 such that a laser designation signal generated by laser 46 reflects off beam splitter 36 along first optical path 100 in alignment with the boresight target signal.

Rangefinder 23 is interposed between laser 46 and beam splitter 36 to measure the time delay between when a light pulse leaves laser 46 and when it returns after reflecting off target 110. The measured time delay is used to calculate the range of target 110.

While various components may be used for boresight target generator 28, collimating lens 34, and beam splitter 36, suitable and presently preferred components are disclosed in U.S. Pat. No. 5,025,149 entitled, "Integrated Multi-spectral Boresight Target" to Hatfield, which is assigned to the assignees of the present invention and is incorporated by reference herein.

Planar reflector element 38 located along optical path 100 reflects a signal transmitted along optical path 100 into pre-expander 40 which employs concave mirrors 42, 44 to magnify the signal. Planar reflector element 50 located along optical path 100 directs the signal towards beam splitter 52. Beam splitter 52 transmits the visible and infrared components of the boresight target signal along optical path 100. In addition, front surface 54 of beam splitter 52 is adapted to reflect the laser designation signal along optical path 106.

Corner reflector 60 located at the end of optical path 100 opposite boresight target generator 28 retro-reflects the boresight target signal back precisely parallel along optical path 100 towards beam splitter 52. The rear surface 56 of beam splitter 52 reflects a portion of the retro-reflected boresight target signal along optical path 102.

Beam splitter 58 located along optical path 102 transmits the visible frequency component of the target signal further along optical path 102 and reflects the infrared frequency component of the target signal, either the boresight target signal or the return signal, along optical path 104. Sensor 22, such as a TV sensor, located at the end of optical path 102 opposite beam splitter 52, senses the visible frequency component of the target signal and generates a visible image therefrom. Sensor 24, such as a FLIR, located at the end of third optical path 104 opposite second beam splitter 58, senses the infrared frequency component of the target signal and generates a visible image therefrom.

Telescope 12, located adjacent to beam splitter 52 along optical path 106 enables the laser designation signal generated by laser 46 to be projected out onto target 110 (not shown). Telescope 12 includes concave mirror 14, convex mirror 16, and concave mirror 18 for magnifying and directing the target signal along optical path 106.

Sensor shutter 26, located along optical path 102 between beam splitter 52 and corner reflector 60, can be positioned to prevent residual laser energy transmitted through beam splitter 52 from damaging sensors 22, 24. Boresight shutter 20, located along optical path 106 can be positioned to prevent the boresight target signal from being transmitted through telescope 12.

Boresight mechanism 10 is shown operating in a boresighting mode in FIG. 2. Boresight target generator 28 is energized causing a boresight target signal measuring approximately one-quarter of one inch in diameter to be transmitted along optical path 100. The visible and infrared frequency component of the boresight target signal are collimated by collimating lens 34, transmitted through beam splitter 36 and reflected by planar reflector element 38 into pre-expander 40. The boresight target signal is expanded fourfold by concave mirrors 42, 44 to approximately one inch in diameter. The expanded boresight target signal is reflected by planar reflector element 50 and transmitted through beam splitter 52 into corner reflector 60. Boresight shutter 20 is positioned along optical path 106 to prevent boresight target signal reflected off the front surface 54 of beam splitter 52 from being transmitted along optical path 106 and out telescope 12. The boresight target signal transmitted through beam splitter 52 is retro-reflected by corner reflector 60 back towards beam splitter 52 such that the boresight target signal entering and exiting corner reflector 60 along optical path 100 are precisely parallel.

The rear surface 56 of beam splitter 52 reflects approximately one percent (1%) of the boresight target signal along optical path 102. The balance of the retro-reflected boresight target signal is transmitted through beam splitter 52 back along optical path 100. The boresight target signal reflected along optical path 102 encounters beam splitter 58. The visible frequency component of the boresight target signal is transmitted through beam splitter 52 and received by sensor 22, while the infrared frequency component of the boresight target signal is reflected off beam splitter 52 along optical path 104 and received by second sensor 24. The visual and infrared components of the boresight target signal are used to precisely align first and second sensors 22, 24 with the boresight target signal.

Boresight mechanism 10 is shown operating in a rangefinding/laser designation mode in FIG. 3. Laser 46 is energized to generate a laser designation signal, approximately one-quarter of one inch in diameter which is projected onto beam splitter 36 and reflected along first optical path 100 as shown. The laser designation signal is reflected by planar reflector element 38 into pre-expander 40 and magnified by concave mirrors 42, 44 to approximately one inch in diameter. Planar reflector element 50 reflects the expanded laser designation signal onto the front surface 54 of beam splitter 52 where the laser designation signal is reflected along optical path 106. Sensor shutter 26 is positioned along optical path 100 in front of corner reflector 60 so that laser designation signal which may be transmitted through beam splitter 56 will not be transmitted onto sensors 22, 24.

Beam splitter 52 reflects the laser designation signal into telescope 12 where concave mirror 14, convex mirror 16 and concave mirror 18 magnifies the laser designation signal to approximately six inches in diameter and projects it out onto target 110 (not shown). The reflection of the laser designation signal from target 110 generates a return signal which can be used by laser-guided weapons to track the desired target.

In this mode of operation, telescope 12 is also employed to receive the target signal, such as the return signal. The return signal is magnified by telescope 12 and directed towards beam splitter 52 along the optical path 106. Beam splitter 52 transmits the visible and infrared frequency components of the target signal along optical path 102. Beam splitter 58 transmits the visible frequency component of the target signal along optical path 102 where it is received by sensor 22. Beam splitter 58 reflects the infrared frequency component of the target signal along optical path 104 where it is received by sensor 24.

In the preferred embodiment the laser designation signal is transmitted through rangefinder 23 to initialize a timing function. A portion of the return signal reflected off target 110 and received by telescope 12 as described above is reflected off the front surface 54 of beam splitter 52 along optical path 100. Beam splitter 36 reflects the return signal back into rangefinder 23 to stop the timing function. From this data rangefinder 23 calculates the range of target 110.

From the foregoing, those skilled in the art should realize that the present invention provides an improved multi-sensor, electro-optical fire control system which incorporates internal boresight target generator 28 to precisely align sensors 22, 24 without firing laser 46. The present invention greatly reduces the likelihood of a mishit resulting from improper alignment of sensors 22, 24 with the line of sight of the laser designation signal. The present invention significantly improves on the previous state of the art which relied on external boresight targets illuminated by a laser, or factor preset mechanical boresight alignments, or a combination of the two. The accuracy of the boresighting procedure is improved by locating boresight target generator 28 and laser 46 on optical bench 11. Substantial safety hazards associated with firing the high powered laser are eliminated by incorporating boresight target generator 28. The present invention further provides a boresight mechanism that utilizes fixed powered optical components and a common aperture telescope to reduce boresight error buildup. Furthermore, the present invention allows sensors 22, 24 to be boresighted during flight with the entire boresighting process requiring less than 10 seconds as compared with several minutes for other boresighting mechanisms. As a result, the present invention provides a more maintainable, smaller, lighter, less expensive, higher performance boresight mechanism for an electro-optical fire control system. Although the invention has been described with particular reference to a preferred embodiment, variations and modifications can be effected within the spirit and scope of the following claims.

What we claim is:

1. A multi-sensor, electro-optical boresight mechanism comprising:

an optical bench:

a telescope, mounted to said optical bench, for receiving a target signal;

first sensor means, mounted to said optical bench, for sensing a first frequency component of said target signal and generating an image therefrom;

second sensor means, mounted to said optical bench, for sensing a second frequency component of said target signal and generating an image therefrom;

boresight target generation means, mounted to said optical bench, for internally generating a boresight target signal along a first optical path; and optical means, mounted to said optical bench, for allowing said first and second means to sense said boresight target signal;

corner reflector means disposed at an end of the first optical path opposite the boresight target generation means for retro-reflecting the boresight target signal;

first beam splitter means interposed between the boresight target generation means and the corner reflector means along the first optical path for transmitting the boresight target signal towards the corner reflector means along the first optical path and reflecting said boresight target signal retro-reflected by said corner reflector means from a rear surface thereof along a second optical path;

said first sensor means being disposed along the second optical path opposite the first beam splitter means; and second beam splitter means interposed between the first beam splitter means and the first sensor means along the second optical path for transmitting the first frequency component of the boresight target signal towards the first sensor means and reflecting the second frequency component of the boresight target signal therefrom along a third optical path;

said second sensor means being disposed along the third optical path opposite the second beam splitter means.

2. A multi-sensor, electro-optical boresight mechanism comprising:

an optical bench;

a telescope, mounted to said optical bench, for receiving a target signal;

first sensor means, mounted to said optical bench, for sensing a first frequency component of said target signal and generating an image therefrom;

second sensor means, mounted to said optical bench, for sensing a second frequency component of said target signal and generating an image therefrom;

boresight target generation means, mounted to said optical bench, for internally generating a boresight target signal along a first optical path;

optical means, mounted to said optical bench, for allowing said first and second means to sense said boresight target signal; and pre-expander means interposed between the boresight target generation means and the telescope for magnifying a signal transmitted along the first optical path.

3. A multi-sensor, electro-optical boresight mechanism comprising:

an optical bench;

a telescope, mounted to said optical bench, for receiving a target signal;

first sensor means, mounted to said optical bench, for sensing a first frequency component of said target signal and generating an image therefrom;

second sensor means, mounted to said optical bench, for sensing a second frequency component of said target signal and generating an image therefrom;

boresight target generation means, mounted to said optical bench, for internally generating a boresight target signal along a first optical path;

optical means, mounted to said optical bench, for allowing said first and second means to sense said boresight target signal; and sensor shutter means for blocking a signal prior to impingement on the first or second sensor means.

4. A multi-sensor, electro-optical boresight mechanism comprising:

an optical bench;

a telescope, mounted to said optical bench, for receiving a target signal;

first sensor means, mounted to said optical bench, for sensing a first frequency component of said target signal and generating an image therefrom:

second sensor means, mounted to said optical bench, for sensing a second frequency component of said target signal and generating an image therefrom;

boresight target generation means, mounted to said optical bench, for internally generating a boresight target signal along a first optical path;

optical means, mounted to said optical bench, for allowing said first and second means to sense said boresight target signal; and boresight shutter means for blocking a signal being transmitted or received through the telescope.

5. A multi-sensor, electro-optical boresight mechanism comprising:

an optical bench:

a telescope, mounted to said optical bench, for receiving a target signal;

first sensor means, mounted to said optical bench, for sensing a first frequency component of said target signal and generating an image therefrom;

second sensor means, mounted to said optical bench, for sensing a second frequency component of said target signal and generating an image therefrom;

boresight target generation means, mounted to said optical bench, for internally generating a boresight target signal along a first optical path; and optical means, mounted to said optical bench, for allowing said first and second means to sense said boresight target signal, said optical means further comprising beam splitter means disposed adjacent to the laser source means for reflecting the laser designation signal therefrom and transmitting the boresight target signal along the same optical path.

6. A common aperture, multi-sensor, electro-optical boresight mechanism comprising:

an optical bench;

a telescope, mounted to said optical bench, for receiving a target signal;

first sensor means, mounted to said optical bench, for sensing a visible frequency component of said target signal and generating an image therefrom;

second sensor means, mounted to said optical bench, for sensing an infrared frequency component of said target signal and generating an image therefrom;

laser source means, mounted to said optical bench, for transmitting a laser designation signal through said telescope, boresight target generation means, mounted to said optical bench, for internally generating a boresight target signal;

optical means, mounted to said optical bench, for allowing said first and second sensor means to sense said boresight target signal;

said boresight mechanism further third beam splitter means disposed adjacent to the laser source means for reflecting the laser designation signal therefrom and transmitting the boresight target signal along the first optical path;

corner reflector means disposed at an end of the first optical path opposite the boresight target generation means for retro-reflecting the boresight target signal;

first beam splitter means interposed between the boresight target generation means and the corner reflector means along the first optical path for reflecting said laser designation signal from a front surface thereof along a fourth optical path, transmitting the boresight target signal towards the corner reflector means along the first optical path and reflecting said boresight target signal retro-reflected by said corner reflector means from a rear surface thereof along a second optical path;

said first sensor means disposed at an end of the second optical path opposite the first beam splitter means;

second beam splitter means interposed between the first beam splitter means and the first sensor means along the second optical path for transmitting the first frequency component of the boresight target signal towards the first sensor means and reflecting the second frequency component of the boresight target signal therefrom along a third optical path; and said second sensor means disposed at an end of the third optical path opposite the second beam splitter means.

7. A common aperture, multi-sensor, electro-optical boresight mechanism comprising:

an optical bench:

a telescope, mounted to said optical bench, for receiving a target signal;

first sensor means, mounted to said optical bench, for sensing a visible frequency component of said target signal and generating an image therefrom;

second sensor means, mounted to said optical bench, for sensing an infrared frequency component of said target signal and generating an image therefrom;

laser source means, mounted to said optical bench, for transmitting a laser designation signal through said telescope;

boresight target generation means, mounted to said optical bench, for internally generating a boresight target signal;

optical means, mounted to said optical bench, for allowing said first and second sensor means to sense said boresight target signal; and pre-expander means interposed between the boresight target generation means and the telescope for magnifying the boresight target signal and the laser designation signal.

8. A common aperture, multi-sensor, electro-optical boresight mechanism comprising:

an optical bench:

a telescope, mounted to said optical bench, for receiving a target signal;

first sensor means, mounted to said optical bench, for sensing a visible frequency component of said target signal and generating an image therefrom;

second sensor means, mounted to said optical bench, for sensing an infrared frequency component of said target signal and generating an image therefrom;

laser source means, mounted to said optical bench, for transmitting a laser designation signal through said telescope;

boresight target generation means, mounted to said optical bench, for internally generating a boresight target signal;

optical means, mounted to said optical bench, for allowing said first and second sensor means to sense said boresight target signal; and sensor shutter means for averting the target signal prior to impingement on the first or second sensor means.

9. A common aperture, multi-sensor, electro-optical boresight mechanism comprising:

an optical bench:

a telescope, mounted to said optical bench, for receiving a target signal;

first sensor means, mounted to said optical bench, for sensing a visible frequency component of said target signal and generating an image therefrom;

second sensor means, mounted to said optical bench for sensing an infrared frequency component of said target signal and generating an image therefrom;

laser source means, mounted to said optical bench for transmitting a laser designation signal through said telescope;

boresight target generation means, mounted to said optical bench, for internally generating a boresight target signal;

optical means, mounted to said optical bench, for allowing said first and second sensor means to sense said boresight target signal; and boresight shutter means for averting the target signal being transmitted or received through the telescope.

10. A multi-sensor, electro-optical boresight mechanism comprising:

boresight target generation means for internally generating a boresight target signal along a first optical path, said boresight target generation means including:

source bulb means for generating an incandescent boresight target signal, target plate means disposed adjacent to the source bulb means having a pinhole aperture sufficiently sized for attenuating the incandescent boresight target signal, and collimating means disposed adjacent to the target plate means for collimating the boresight target signal;

corner reflector means fixedly disposed at an end of the first optical path opposite the boresight target generation means for retro-reflecting the boresight target signal;

laser source means located adjacent to the boresight target generation means for transmitting a laser designation signal;

third beam splitter means disposed adjacent to the boresight generation means for reflecting the laser designation signal therefrom along the first optical path and transmitting the boresight target signal along the first optical path;

pre-expander means interposed between the boresight target generation means and the corner reflector means for low-magnifying the boresight target signal and the laser designation signal;

first beam splitter means interposed between the pre-expander means and the corner reflector means along the first optical path for reflecting said laser designation signal from a front surface thereof along a fourth optical path, transmitting the boresight target signal towards the corner reflector means along the first optical path and reflecting said boresight target signal retro-reflected by said corner reflector means from a rear surface thereof along a second optical path;

telescope means located along the fourth optical path having an aperture for receiving a target signal or transmitting the laser designation signal;

first sensor means disposed at an end of the second optical path opposite the first beam splitter means for sensing a visible frequency component of said target signal in pre-expanded space and generating a visible image therefrom;

second beam splitter means interposed between the first beam splitter means and the first sensor means along the second optical path for transmitting the visible frequency component of said target signal towards the first sensor means and reflecting an infrared frequency component of said target signal therefrom along a third optical path;

second sensor means disposed at an end of the third optical path opposite the second beam splitter means for sensing the infrared frequency component of said target signal in pre-expanded space and generating a visible image therefrom;

sensor shutter means for blocking the target signal prior to impingement on the first or second sensor means; and boresight shutter means for blocking the target signal being transmitted or received along the fourth optical path.

11. A multi-sensor, electro-optical boresight mechanism comprising:

telescope means having an aperture for receiving a target signal;

first sensor means for sensing a first frequency component of said target signal in pre-expanded space and generating an image therefrom;

second sensor means for sensing a second frequency component of said target signal in pre-expanded space and generating an image therefrom;

boresight target generation means for internally generating a boresight target signal along a first optical path;

corner reflector means disposed along the first optical path for retro-reflecting the boresight target signal;

first beam splitter means interposed along the first optical path between the boresight target generation means and the corner reflector means for transmitting the boresight target signal towards the corner reflector means along the first optical path and for reflecting the retro-reflected boresight target signal along a second optical path;

second beam splitter means disposed along the second optical path between the first beam splitter means and the first sensor means for transmitting the first frequency component of the target signal towards the first sensor means and reflecting the second frequency component of the boresight target signal along a third optical path towards the second sensor means.

* * * * *